US007571821B2

(12) United States Patent
Noble Colin

(10) Patent No.: US 7,571,821 B2
(45) Date of Patent: Aug. 11, 2009

(54) DISPLAY RACK

(75) Inventor: Maria Alejandra Noble Colin, Col. San Jerónimo Lidice (MX)

(73) Assignee: Sabritas, S. De R.I. De C.V., Colonia Lomas de Chapultepex (MX)

( * ) Notice: Subject to any disclaimer, the term of this patent is extended or adjusted under 35 U.S.C. 154(b) by 298 days.

(21) Appl. No.: 11/426,149

(22) Filed: Jun. 23, 2006

(65) Prior Publication Data

US 2007/0295681 A1 Dec. 27, 2007

(51) Int. Cl.
*A47F 5/08* (2006.01)

(52) U.S. Cl. ..... 211/90.3

(58) Field of Classification Search ..... 211/44, 211/49.1, 59.2, 74, 75, 85.26, 85.31, 112, 211/126.1, 126.12, 126.2, 126.9, 188, 194, 211/90.03, 90.01, 106; 108/59, 91, 92, 59.91, 108/106, 108, 147.17, 147.11; D6/462; 312/9.9, 312/10

See application file for complete search history.

(56) References Cited

U.S. PATENT DOCUMENTS 65,152 A * 5/1867 Anthony ..... 211/112
234,452 A * 11/1880 Ayres ..... 108/151
2,964,200 A * 12/1960 King ..... 108/135
3,393,888 A * 7/1968 Henningsgard ..... 248/230.8
3,797,790 A * 3/1974 Iseki ..... 248/230.2
5,351,923 A * 10/1994 Booth, Jr. ..... 248/217.1
7,128,221 B2 * 10/2006 Metcalf ..... 211/59.2
2002/0027115 A1 * 3/2002 Gay et al. ..... 211/187

OTHER PUBLICATIONS

U.S. Appl. No. 11/419,004, filed May 18, 2006, Battaglia, et al.
"Display Shelving Components" by Lozier Corporation, found at http://www.lozier.com/mod5-ic.htm, dated Nov. 18, 2005.

* cited by examiner

*Primary Examiner*—Sarah Purol
(74) *Attorney, Agent, or Firm*—Bobby W. Braxton; Colin P. Cahoon; Carstens & Cahoon, LLP

(57) ABSTRACT

A display rack having a support frame and at least one tray for holding and displaying product. Each tray attaches at its rear to the support frame by way of at least one moveable suspension arm and at least two possible tray-to-frame buttress points (or stops) for every suspension arm. The at least two tray-to-frame buttress points act together as a dual-position stop, which dual-position stop is capable of maintaining the tray in two different orientations with respect to the support frame. In a preferred embodiment, each tray has two L-shaped, pivoting suspension arms, where a portion of each suspension arm is horizontal and passes through a receiving channel in the support frame.

26 Claims, 5 Drawing Sheets

DISPLAY RACK

BACKGROUND OF THE INVENTION

1. Technical Field

The present invention relates generally to a display shelving system. More specifically, the invention relates to a wire-rack display having shelves that are easily moved into a display position and a loading position. The display position inclines individual product shelves or trays so that the product is gravity fed to the front of each shelf while the loading position places the shelves on a horizontal orientation.

2. Description of Related Art

Retail display shelving commonly used in grocery stores, department stores, discount stores, and other retail outlets that display items on shelves, are manufactured by numerous companies in a plethora of models and design choices. The units that are typically found in a grocery store to display items for sale, such as bags of salty snacks, are typically self-contained with multiple shelves.

Although there are variations amongst the units offered by different manufacturing companies, the basic design is fairly well established, and there are many common features shared industry wide. In the prior art, a common display apparatus is a gondola-type unit, which typically has a back panel vertically oriented and held in position by connection to at least one upright, which is also vertically oriented. The connection to the upright is accomplished by at least a bottom rail, a center rail, and a top rail, although more horizontal rails can be used for this purpose. The vertical uprights are stabilized by at least one, and typically two, base legs or brackets. One or more shelves can be horizontally positioned in numerous locations relative to the back panel by virtue of connections between the shelf and the uprights. A base deck or shelf is maintained off of the surface upon which the entire unit sits by being supported by the base brackets. A closed base front encloses the space beneath the base deck in conjunction with the base deck and base bracket trim, when said base and trim also covers the base brackets. The gondola unit may have other trim components, such as the upright and trim, which cover the upright. A disadvantage of such a gondola system is that the shelves cannot be moved to different positions or different orientations while carrying product. Thus, every time a shelf is to be moved, all product must be unloaded, the shelf must be moved, and the product must be restocked. A similar problem is shared with many prior art wire-rack display systems. It would be desirable to have a single unit with shelves that could be easily adjusted to more than one orientation without disassembly or product removal.

When using gravity-feed displays having multiple shelves per column, it can be quite difficult to restock product onto the inclined or sloped shelving. As product is placed onto a gravity-fed shelf, the product tends to slide down to the lower, front side of the shelf Furthermore, with each subsequent placement of product, the re-stocker must either push the already-placed product upwards and back towards the rear of the shelf in order to make room for the next product or the re-stocker must reach beyond the furthest product piece toward the rear and up between the current shelf and the shelf above (if any), which is often out of the re-stocker's line of sight. It is much easier to restock lines of product onto horizontal, non-gravity-fed shelves than it is to restock inclined, gravity-fed shelves. It would therefore be desirable for a single display rack to have a horizontal loading orientation and a gravity-fed displaying orientation.

Nothing in the prior art addresses the problem associated with changing shelf orientation without disassembly or product removal. Furthermore, a need exists for a display system capable of, and easily alternated between, a gravitational-feed orientation and a non-gravitational-feed orientation. The present invention fills these needs and other needs as detailed more fully below.

BRIEF SUMMARY OF THE INVENTION

A preferred embodiment of the present invention provides a display rack having a support frame and at least one tray or shelf (such term used interchangeably herein) for holding and displaying product. Each tray attaches at its rear to the support frame by way of at least one moveable suspension arm and at least two possible tray-to-frame buttress points (or stops) for every suspension arm. The at least two tray-to-frame buttress points act together as a dual-position stop, which dual-position stop is capable of maintaining the tray in two different orientations with respect to the support frame. In a preferred embodiment, each tray has two L-shaped, pivoting suspension arms, where a portion of each suspension arm is horizontal and passes through a receiving channel in the support frame, while another portion of each suspension arm is perpendicular to, and longer than, the horizontal portion and extends down to the rear of the tray. With a horizontally-transposable arrangement connecting the tray to the support frame in accordance with a preferred embodiment, the entire tray can be moved laterally with respect to the support frame, which then moves the horizontal portion of each suspension arm along its corresponding receiving channel. Depending on the lateral position of each tray relative to the support frame, the back of the tray is propped against the support frame by one of the two stops of the dual-position stop. One of the stops in the dual-position stop causes the tray to sit horizontally, while the other stop causes the tray to cant downward (declining from back to front; inclined from front to back). This downward cant facilitates the gravity feed of product in the tray to the front (or consumer) side of the display rack. The horizontal position facilitates loading of the tray with product.

The invention accordingly comprises the features described more fully below, and the scope of the invention will be indicated in the claims. Further objects of the present invention will become apparent in the following detailed description.

BRIEF DESCRIPTION OF THE DRAWINGS

The novel features which are characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

Like reference numerals represent equivalent parts throughout the several drawings.

REFERENCE NUMERALS

Figure 1A:
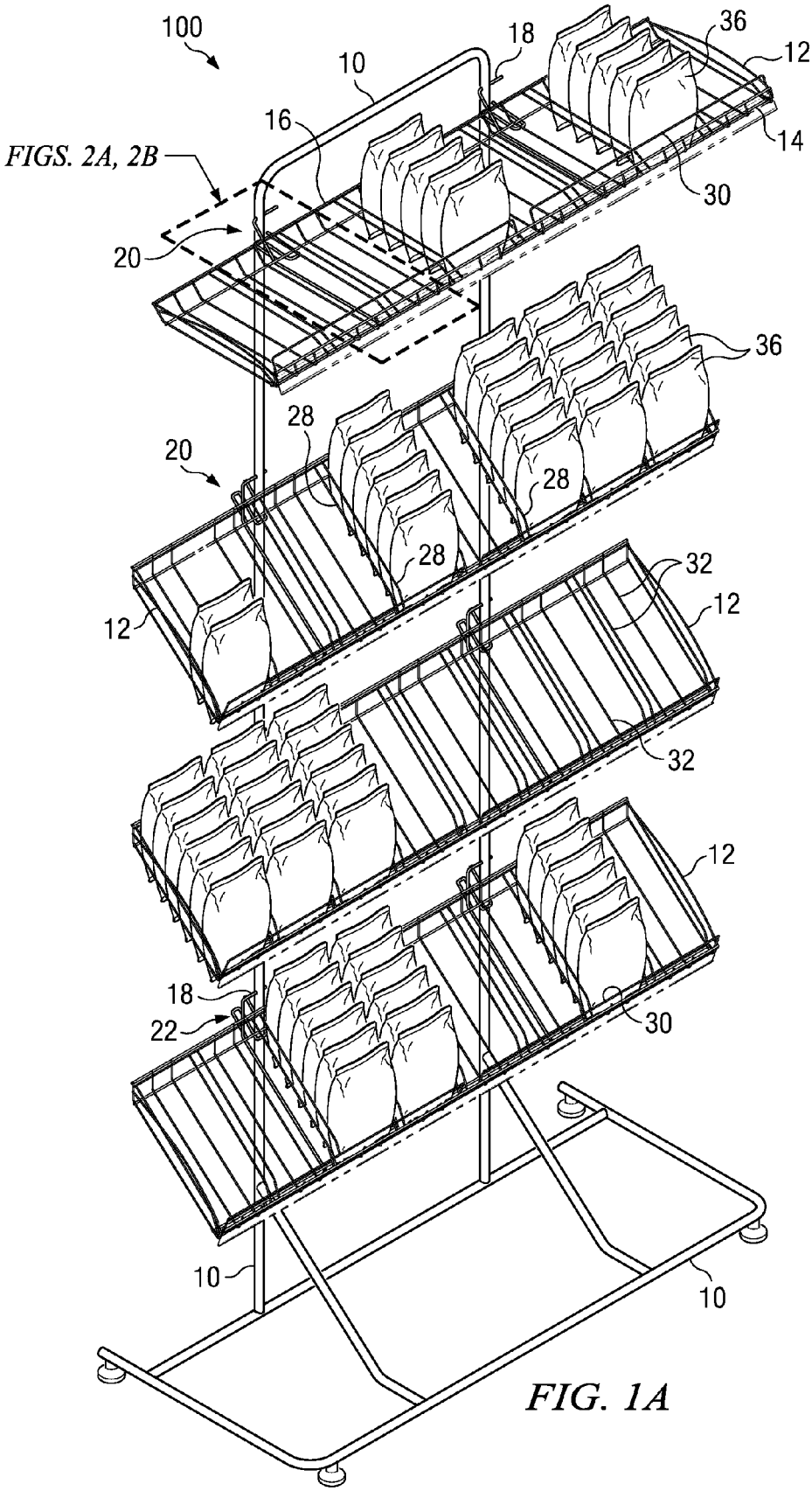
FIG. 1A is an elevated perspective view of a display rack in accordance with a preferred embodiment of the present invention.

10 support frame
12 product presentation shelf/tray
14 front side of shelf
16 back/rear side of shelf
18 suspension/support arm
20 horizontally transposable connecting arrangement
22 dual-position stop
24 first stop of dual-position stop
26 second stop of dual-position stop
28 product divider
30 product stop
32 wire element
34A angle between suspension arm and dual-position stop
36 product being displayed
38 channel/hole for receiving suspension arm
40A rack tilt angle
42 horizontal/lateral movement
44 rotational/pivoting motion
100 display rack

DETAILED DESCRIPTION OF THE INVENTION

Figure 1B:
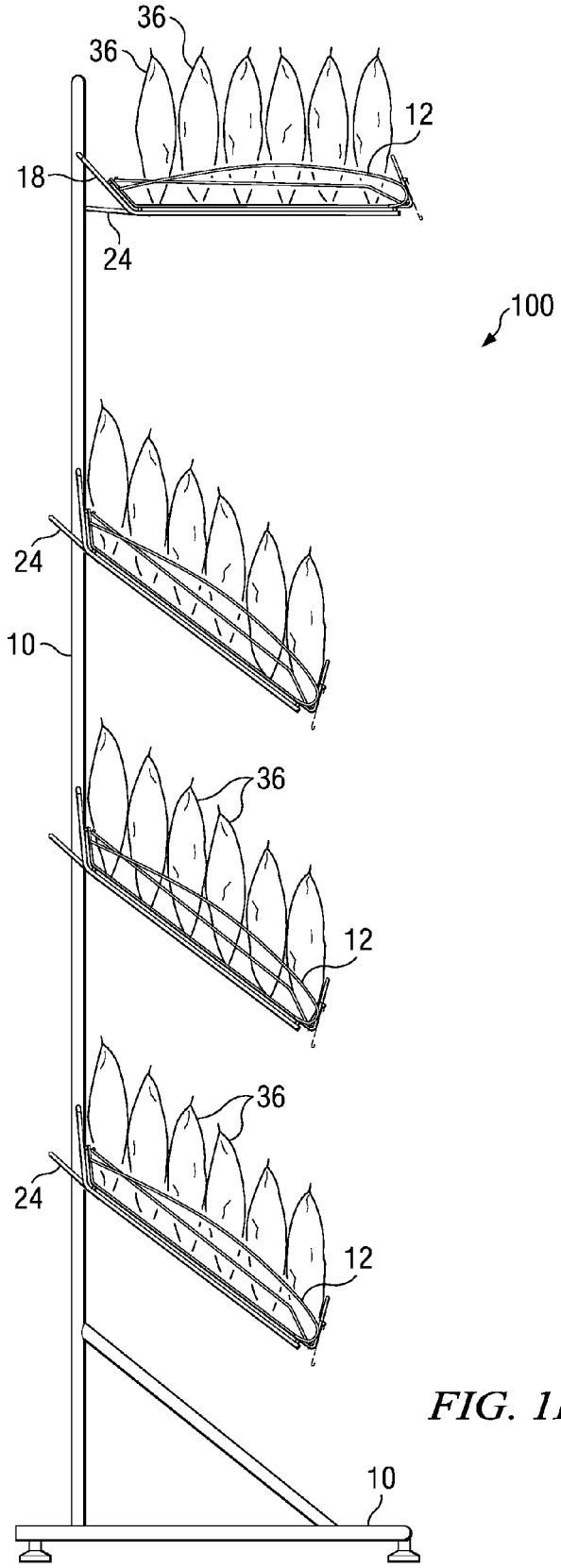
FIG. 1B is an elevated side view of the display rack shown in FIG. 1A.
Figure 2A:
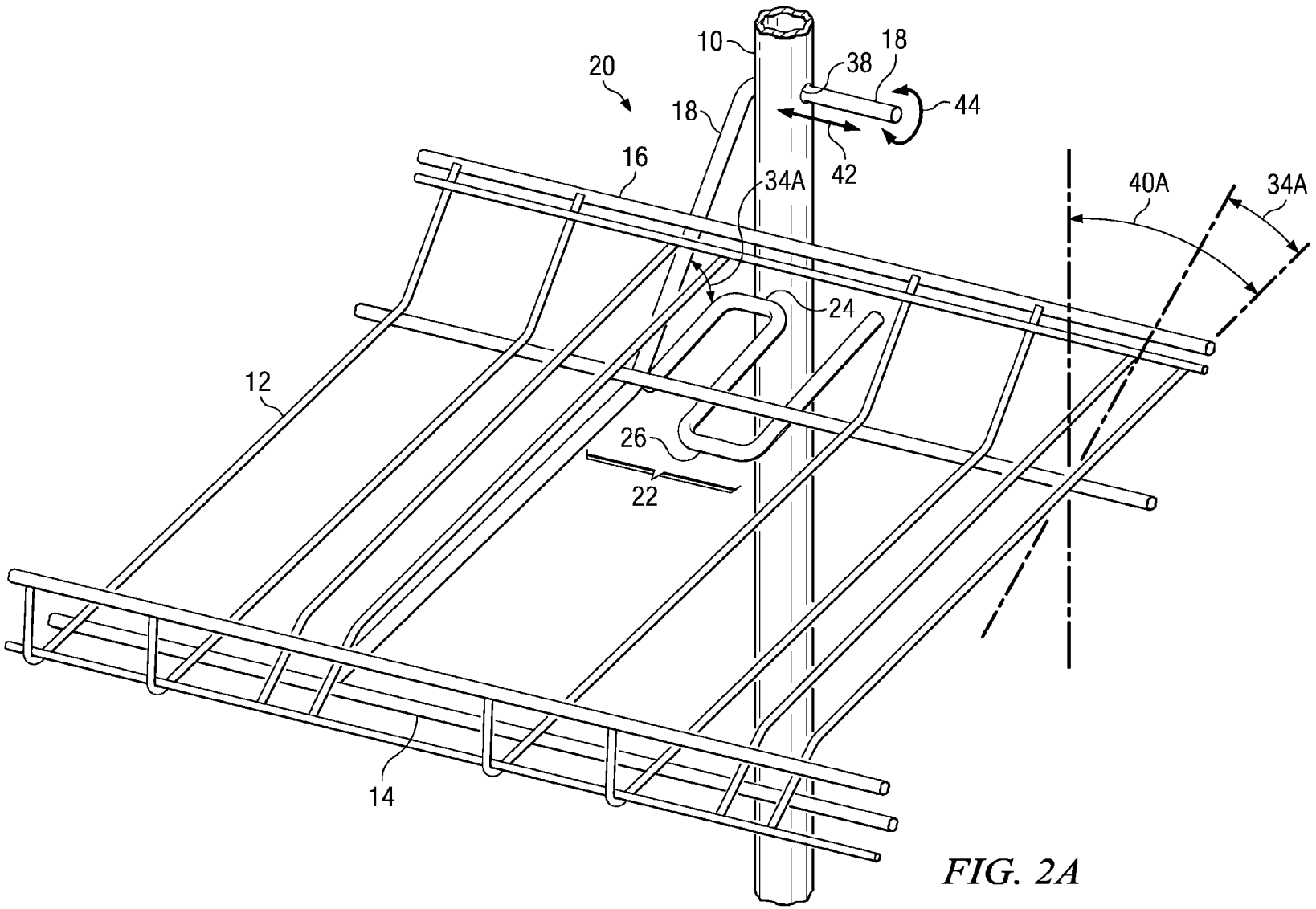
FIG. 2A is an enlarged, perspective view of the horizontally-transposable connecting arrangement shown in FIG. 1A, with the tray shown in a horizontal, product-loading position.
Figure 2B:
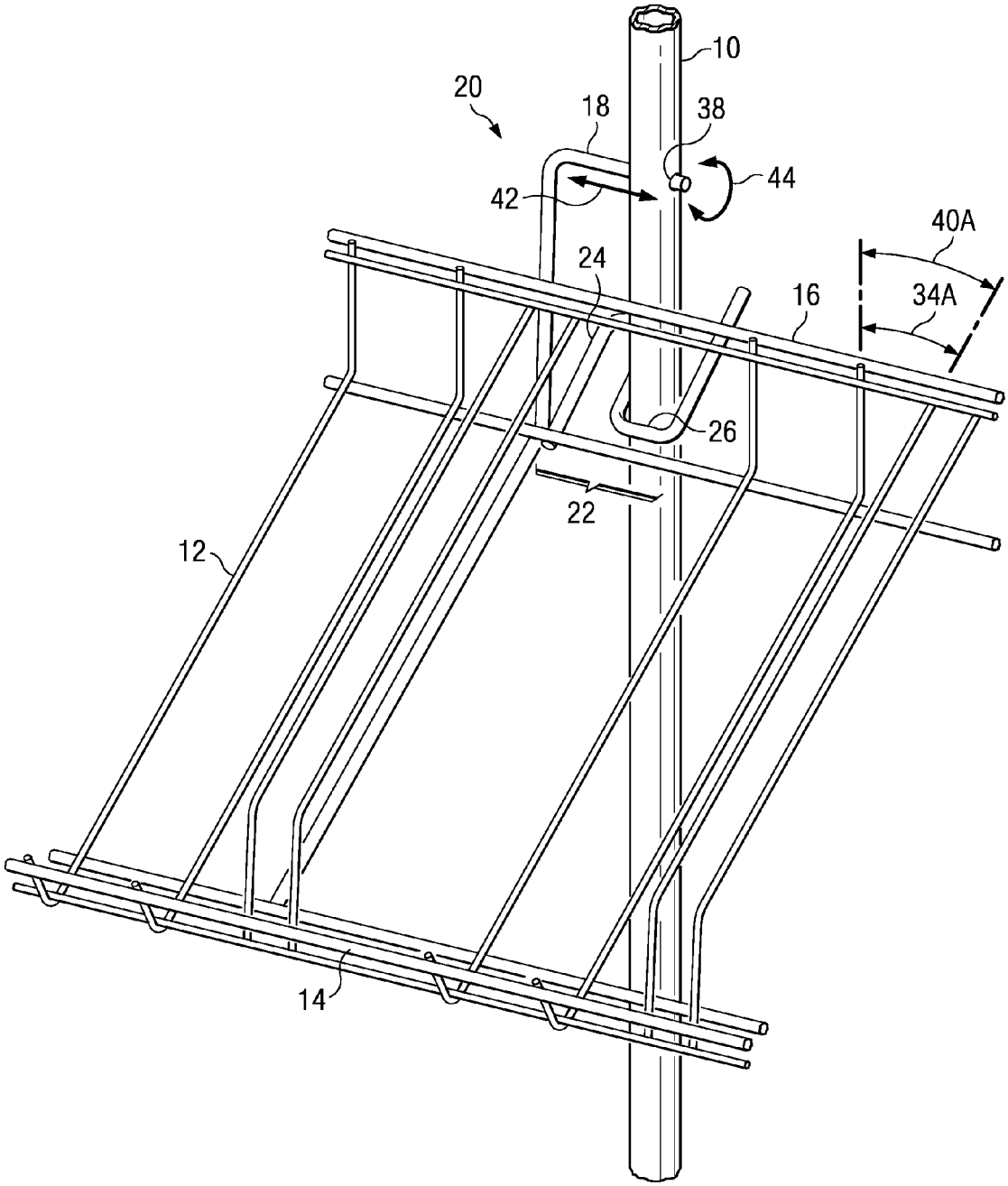
FIG. 2B is an enlarged, perspective view of a horizontally-transposable connecting arrangement similar to that shown in FIG. 2A but with the tray shown in a canted, product-displaying position and with a slightly-altered product-displaying stop.
Figure 3:
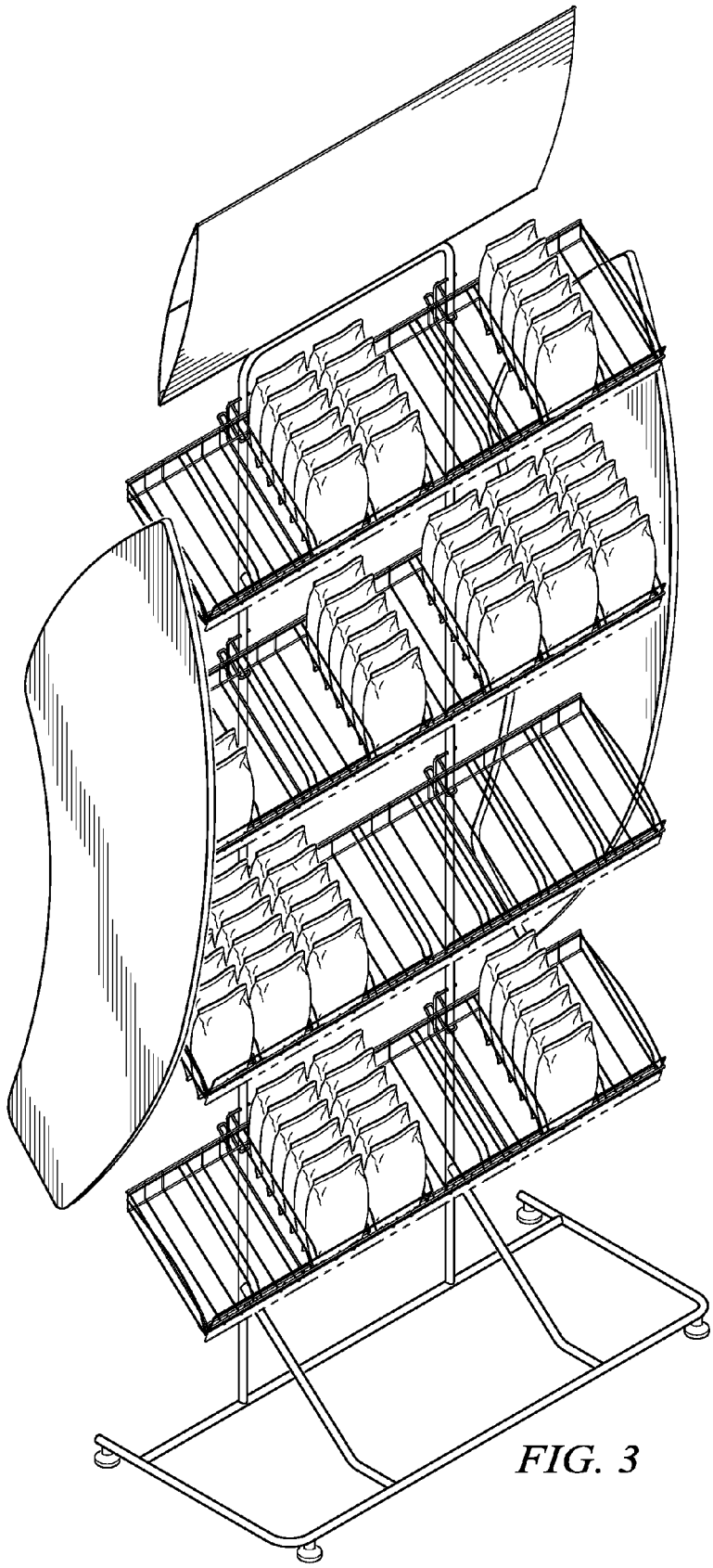
FIG. 3 is an elevated perspective view of an embodiment of the display rack of the present invention further comprising advertising panels on the sides and top of the display rack.

Referring now to the provided drawings, similar reference numerals represent the equivalent component throughout the several views of the drawings. FIG. 1A is an elevated perspective view of a display rack in accordance with a preferred embodiment of the present invention. FIG. 1B is an elevated side view of the display rack shown in FIG. 1A. FIG. 2A is an enlarged, perspective view of the horizontally-transposable connecting arrangement 20 shown in FIG. 1A, with the tray shown in a horizontal, product-loading position. FIG. 2B is an enlarged, perspective view of the horizontally-transposable connecting arrangement shown in FIG. 1A, with the tray shown in a canted, product-displaying position. FIG. 3 is an elevated perspective view of an embodiment of the display rack of the present invention further comprising advertising panels on the sides and top of the display rack.

As illustrated in FIGS. 1A, 1B, 2A, 2B, and 3, a preferred embodiment of the product display rack 100 of the present invention comprises: a support frame 10, at least one product displaying shelf (or tray) 12; at least one suspension arm 18 securing the shelf 12 to the support frame 10 by suspension from, and horizontally-transposable pivot about, a horizontal portion of the suspension arm 18 that is inserted into and cradled by a receiving channel 38 within the support frame 10; and at least one dual-position stop 22 at the rear 16 of each shelf 12, which dual-position stop 22 abuts the support frame 10 in one of two possible positions—a product-loading position 24 and a product-displaying position 26. Note, however, that other embodiments of the invention are possible. For example, the dual-position stop 22 can be substituted with a multiple position stop having three or more stopping surfaces for abutment against the support frame 10. Each shelf 12 can have two or more suspension arms 18 and two or more dual position steps 22.The underlying requirement is that each shelf 12 should have at least one stop associated with the back side of the shelf 12, and said at least one stop should have at least a first stop position and a second stop position, with additional stop positions possible for providing additional shelf orientations.

In a preferred embodiment, the shelves 12 are made of sturdy wire 32, such as that constructed of steel, aluminum, or an alloy. The shelves 12 can have product dividers 28 to keep the products within organized columns and/or rows. The product dividers 28 can be either built-in as part of the wire-rack assembly (preferably constructed of wire), or they can be added separately. For example, the product dividers 28 can be made of strips or plates of stiff plastic and secured along the shelves 12 to define lanes for organizing product packages 36.

In operation, the horizontally transposable connecting arrangement 20 allows the user to alternate the orientation of the shelves 12 independently from one another into either a displaying orientation as shown in FIG. 2B or a loading orientation as shown in FIG. 2A. The horizontal portion of the suspension arm 18 can be removed entirely from a receiving channel 38 in order to allow the shelf to be repositioned within the display rack 100 since, in a preferred embodiment, the vertical member(s) of the support frame 10 will have a plurality of equally spaced receiving ports 38 along its vertical length. Preferably, the dual-position stop 22 has two stop positions that parallel the rear 16 of the shelf (or shelves) 12, the surfaces of which (stop positions) are at different depths, i.e. different positions relative to the rear of a given shelf. In the embodiments illustrated in FIGS. 1-3, the dual-position stop 22 comprises an S-shaped wire affixed to the rear 16 of each wire shelf 12. Of the two straight, width-wise portions of the S-shaped dual-position stop 22 that run parallel to the rear 16 of the shelf 12, the portion extending farthest back beyond the rear 16 of the shelf 12 acts as a product-loading orientation stop 24. The other width-wise portion, on the other hand, is further forward, which alters the orientation of the shelf 12 when suspended along the vertical portion of the support flame 10, thereby giving rise to a product-displaying-orientation step 24. Note that the S-shaped, dual-position stop 22 depicted in FIG. 2B is slightly further back than the dual-position stop 22 shown in FIG. 2A. Attention is brought to this difference, however, only as an example of acceptable variations in the invention that do not affect the general operation and effect of the invention.

In another embodiment, the dual-position stop 22 extends from the rear end of the portion of the stop 22 comprising the product-displaying orientation stop 26 in a direction towards the support frame 10 and parallel to the horizontal portion of the suspension arm 18 (this feature is not shown in the Figures). Such extension of the dual-position stop 22 thus passes behind the support frame 10 when the shelf 12 is in the product-displaying position and prohibits the shelf 12 from moving beyond an approximately horizontal orientation when it is pulled forward and rotated about the suspension arm 18.

The suspension arm 18 is preferably L-shaped—that is, it has an upright (or substantially vertical) member extending back from the rear of the shelf 12 and also has a horizontal member extending laterally/horizontally (in a transverse direction) from said vertical member's upper end, parallel to the shelf 12 and sized for insertion into a corresponding horizontal receiving port or channel 38 in the vertical member (s) of the support frame 10. The entire tray/shelf 12 can be moved laterally (or in the transverse direction) 42, with the horizontal member of the suspension arm 18 sliding through, but still supported within, the horizontal receiving port or channel 38. Depending on the lateral position of the tray/shelf 12, when the tray 12 and suspension arm 18 are allowed to pivot/rotate 44 about the horizontal member of the suspension arm 18 and come to rest, the dual-position stop 22 will abut either the product-loading stop 24 or the product-displaying stop 26. Thus, the stop position 24, 26 is selected by the transverse orientation of the suspension arm 18 relative to the vertical member of the support frame 10.

The location and positioning of the suspension arm 18 and the dual-position stop 22 are such that left side of the dual-position stop 22 is aligned with, or slightly to the right of, the upright portion of the suspension arm 18. The horizontal portion of the suspension arm 18 extends beyond the right side of the dual-position stop 22. The right side of the dual-position stop 22 extends rearward beyond the product-loading orientation stop 24 (on the left side of the dual-position stop 22) by at least the diameter of the vertical member(s) of the support frame (10). Thus, when a tray/shelf 12 is mounted on the support frame 10, the lateral movement of the tray/shelf 12 relative to the vertical member(s) of the support frame 10 is confined between the upright portion of the suspension arm 18 and the right side of the dual-position stop 22.

In a preferred embodiment, the angle 34A between the dual-position stop 22 and the upright, longer member of the suspension arm 18 ranges from about 30° to about 80°, more preferably from about 40° to about 50°, and is most preferably about 45°. When a tray or shelf 12 is in a product-displaying orientation suitable for gravity-fed dispensing of product 36, as illustrated in FIG. 2B, an acute angle 40A is formed between the product-carrying surface of the tray 12 and the vertical member(s) of the support frame 10, which acute angle 40A also ranges from about 30° to about 80°, more preferably from about 40° to about 50°, and is most preferably about 45°. The product stop(s) 30 at the front 14 of the tray 12 form an acute angle with the front of the tray 12, which, likewise, can range from about 30° to about 80°, preferably matching the angle 40A between the tray 12 and the vertical member of the support frame 10. Such angle, therefore, more preferably ranges from about 40° to about 50°, and is most preferably about 45°. In other words, when the shelf is in a displaying position, it is canted at least 10° from the loading position such that the shelf slopes downward from the rear side of the shelf to the front side of the shelf, thus facilitating the gravity feed to the front side of the shelf. In an alternative embodiment, the shelf is canted at least 20 degrees. In another embodiment, the shelf is canted at least 40 degrees.

In a preferred embodiment, each tray 12 has the following dimensions: a front-to-back depth of roughly 43 centimeters; a side-to-side width of about 104 centimeters; a bottom-to-top height of about 5 centimeters, with the front product stop 30 extending slightly higher than the rest of the tray to about 6 or 7 cm to ensure that product is securely contained while in the gravity-fed display orientation. Each tray has 8 lanes for product, which lanes are defined by 7 pairs of front-to-back wires, with each pair separated by 11 centimeters, and the two wires in each pair being roughly 2 centimeters apart. In a preferred embodiment, there are two dual-position stops 22, each beginning at about 26 centimeters and about 62 centimeters measuring from the left side of the tray and proceeding to the right. Similarly, there are two suspension arms 18, each beginning at about 26 centimeters and about 62 centimeters measuring from the left side of the tray and proceeding to the right. With respect to each dual-position stop 22: its width is approximately 6 centimeters; the left side is about 6 centimeters; the product-loading orientation stop 24 is about 2 centimeters (measured from wire-center to wire-center, with the wire being approximately 0.6 centimeters in diameter); the middle, front-to-back member is about 8 centimeters; the product-displaying orientation stop 26 is about 3 centimeters (measured from wire-center to wire-center); and the right side is about 10 centimeters. With respect to each suspension arm 18: the vertical member is about 11 centimeters, and the horizontal member is about 6 centimeters. With respect to the support frame 10: the base is about 104 centimeters wide and roughly 50 centimeters deep; about 168 centimeters high; the two vertical members of the support frame 10 are about 36 centimeters apart from each other and equidistant from either side of the support frame 10, which corresponds to about 26 centimeters and about 62 centimeters measuring from the left side; beginning about 5 centimeters down from the top of each vertical member of the support frame 10, there are 25 receiving ports/channels spaced at 5 centimeter intervals, each about 0.7 centimeters in diameter. If desired, the two vertical members of the support frame 10 can tilt backwards slightly, such as about 10° from vertical.

All of the dimensions provided for the two described embodiments can be easily varied in order to meet the needs of any particular display rack. While there are many standard sizes of commercial display racks, there can be significant variations that would necessitate adjustments to the required dimensions. The specific embodiment disclosed is most suitable for the display of single-serving size salty snack packages, such as bags of potato chips and tortilla chips. However, the invention is suitable for the display of any product that works in a gravity feed system, such as bagged products, canned products, books, pamphlets, boxed products, canisters and bundled products. While specific embodiments of the invention have been disclosed, one of ordinary skill in the art will recognize that one can modify the dimensions and particulars of the embodiments without straying from the inventive concept.

I claim:

1. A product display rack comprising:

a support frame;

at least one shelf, wherein said shelf comprises a front side and a rear side;

at least one arm attached to the rear side of said at least one shelf wherein said arm is pivotably attached in a horizontally transposable arrangement with said support frame;

at least one multiple position stop associated with the rear side of said at least one product shelf, wherein further said at least one stop comprises at least a first stop position and a second stop position corresponding to a loading position and a displaying position of said shelf;

wherein further said stop position is selected by the transverse orientation of said arm relative to said support frame; and wherein said loading position facilitates loading of said shelf with product, and wherein said displaying position facilitates displaying and gravity feed dispensing of product on said shelf.

2. The product display rack of claim 1 wherein said shelf in said displaying position is canted at least 10 degrees from the loading position such that the shelf slopes downward from the rear side of the shelf to the front side of the shelf, thus facilitating the gravity feed to the front side of the shelf.

3. The product display rack of claim 1 wherein said shelf in said displaying position is canted at least 20 degrees from the loading position such that the shelf slopes downward from the rear side of the shelf to the front side of the shelf, thus facilitating the gravity feed to the front side of the shelf.

4. The product display rack of claim 1 wherein said shelf in said displaying position is canted at least 40 degrees from the loading position such that the shelf slopes downward from the rear side of the shelf to the front side of the shelf, thus facilitating the gravity feed to the front side of the shelf.

5. The product display rack of claim 1 comprising two suspension arms.

6. The product display rack of claim 1 wherein said at least one stop consists of a first and second stop position.

7. The product display rack of claim 1 wherein said at least one shelf further comprises a plurality of product dividers.

8. The product display rack of claim 1 wherein said loading position is substantially horizontal.

9. The product display rack of claim 1 wherein said at least one stop consists of two stops, wherein further each stop consists of a first stop position and a second stop position corresponding to a loading position and a displaying position of said shelf.

10. The product display rack of claim 1 further comprising a product stop attached to the front side of said shelf.

11. The product display rack of claim 1 wherein said shelf comprises wire elements.

12. The product display rack of claim 11 wherein said shelf consists substantially of wire structural members.

13. A product display rack comprising:

a support frame having at least one substantially vertical member wherein said member comprises a plurality of horizontal receiving ports;

at least one tray, wherein each one of said at least one tray comprises at least one L-shaped suspension arm and a corresponding S-shaped dual-position stop, said L-shaped suspension arm having a horizontal portion and an upright portion, and said S-shaped dual-position stop has a left side and a right side;

wherein said tray rotatably attaches to said substantially vertical member of said support frame by transverse insertion of the horizontal portion of said L-shaped suspension arm in one of said horizontal receiving ports of said substantially vertical member of said support frame, wherein further said tray is positionable in either a loading or displaying position dependent on the transverse location of said horizontal portion of said L-shaped suspension arm relative to said substantially vertical member of said support frame, and wherein said loading position facilitates loading of said shelf with product, and wherein said displaying position facilitates displaying and gravity feed dispensing of product on said shelf.

14. The product display rack of claim 13 wherein said S-shaped stop receives the substantially vertical member when the tray is in said displaying position.

15. The product display rack of claim 13 wherein the left side of said S-shaped stop is aligned with, or slightly to the right of, the upright portion of the substantially vertical member of the support frame, and the horizontal portion of the L-shaped suspension arm extends beyond the right side of the dual-position stop.

16. The product display rack of claim 13 wherein said shelf in said displaying position is canted at least 10 degrees from the loading position such that the shelf slopes downward from the rear side of the shelf to the front side of the shelf, thus facilitating the gravity feed to the front side of the shelf.

17. The product display rack of claim 13 wherein said shelf in said displaying position is canted at least 20 degrees from the loading position such that the shelf slopes downward from the rear side of the shelf to the front side of the shelf, thus facilitating the gravity feed to the front side of the shelf.

18. The product display rack of claim 13 wherein said shelf in said displaying position is canted at least 40 degrees from the loading position such that the shelf slopes downward from the rear side of the shelf to the front side of the shelf, thus facilitating the gravity feed to the front side of the shelf.

19. The product display rack of claim 13 wherein said tray has exactly two suspension arms.

20. The product display rack of claim 13 wherein each one of said S-shaped stop consists of a first and second stop position.

21. The product display rack of claim 13 wherein at least one shelf further comprises a plurality of product dividers.

22. The product display rack of claim 13 wherein said loading position is substantially horizontal.

23. The product display rack of claim 13 consisting of two stops, wherein each stop consists of a first stop position and a second stop position corresponding to a loading position and a displaying position of said shelf.

24. The product display rack of claim 13 further comprising a product stop attached to the front side of said shelf.

25. The product display rack of claim 13 wherein said shelf comprises wire elements.

26. The product display rack of claim 25 wherein said shelf consists substantially of wire structural members.

* * * * *